US010971058B1

(12) United States Patent
Cheng et al.

(10) Patent No.: US 10,971,058 B1
(45) Date of Patent: Apr. 6, 2021

(54) DISPLAY APPARATUS

(71) Applicant: Au Optronics Corporation, Hsinchu (TW)

(72) Inventors: He-Yi Cheng, Hsinchu (TW); Yu-Chieh Kuo, Hsinchu (TW); Shang-Jie Wu, Hsinchu (TW); Che-Chia Chang, Hsinchu (TW); Yi-Fan Chen, Hsinchu (TW); Yi-Jung Chen, Hsinchu (TW); Yu-Hsun Chiu, Hsinchu (TW); Mei-Yi Li, Hsinchu (TW); Hsin-Chun Huang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/907,290

(22) Filed: Jun. 21, 2020

(30) Foreign Application Priority Data

Feb. 21, 2020 (TW) ..... 109105618

(51) Int. Cl.
*G09G 3/32* (2016.01)

(52) U.S. Cl.
CPC ..... *G09G 3/32* (2013.01); *G09G 2300/0439* (2013.01)

(58) Field of Classification Search
CPC ..... G09G 3/32; G09G 2300/0439
See application file for complete search history.

(56) References Cited

U.S. PATENT DOCUMENTS 6,380,992 B1 * 4/2002 Lee ..... G02F 1/1309 349/54
9,520,457 B2 * 12/2016 So ..... H01L 51/5237
2005/0174505 A1 * 8/2005 Lai ..... G02F 1/136259 349/54
2015/0379908 A1 * 12/2015 Kim ..... G09G 3/006 345/84
2020/0168585 A1 5/2020 Lo et al.

FOREIGN PATENT DOCUMENTS

CN 107507926 12/2017
TW I679756 12/2019
TW I683431 1/2020

* cited by examiner

*Primary Examiner* — Muhammad N Edun
(74) *Attorney, Agent, or Firm* — JCIPRNET

(57) ABSTRACT

A display apparatus includes pixels, each of which includes first and second pixel driver circuits, first and second driver pads electrically connected to the first and second pixel driver circuits, respectively, a first LED element, first and second connection lines electrically connected to the first and second pixel driver circuits, respectively, and first and second repair pads electrically connected to the first and second connection lines, respectively. A first electrode of the first LED element is electrically connected to the first driver pad. The first repair pad, the second repair pad, the first driver pad, and the second driver pad are structurally separated. A first pixel of the pixels further includes a second LED element overlapping the first and second repair pads of the first pixel, and a first electrode of the second LED element is electrically connected to the second repair pad.

10 Claims, 12 Drawing Sheets

DISPLAY APPARATUS

CROSS-REFERENCE TO RELATED APPLICATION

This application claims the priority benefit of Taiwan patent application serial no. 109105618, filed on Feb. 21, 2020. The entirety of the above-mentioned patent application is hereby incorporated by reference here and made a part of this specification.

BACKGROUND

Technical Field

The disclosure relates to an electronic apparatus, and particularly to a display apparatus.

Description of Related Art

A light-emitting diode (LED) is a light-emitting element characterized by low power consumption, high brightness, high resolution, and high color saturation. Therefore, the LED is suitable for constructing a pixel structure of an LED display panel.

A technology of transferring the LED to a driver substrate having a pixel circuit is called mass transfer. When the LED is transferred, an issue of misplacement of the LED is prone to occur, whereby some pixels in the display apparatus fails to operate normally, significantly affecting the display quality of the display apparatus. In addition, if the LED itself is defective and cannot operate normally, even if the LED is successfully transferred, the display quality of the display apparatus remains affected. In order to better resolve said issue, space is often reserved in pixels to accommodate the LEDs for repairs. However, when the resolution of the display apparatus is improved, the reserved space in the pixels is limited. Therefore, only a repair pad for repairing the LED of one color may be placed in the reserved space, posing a negative impact on the repair effect and the display quality of the display apparatus.

SUMMARY

The disclosure provides a display apparatus with favorable display quality.

According to an embodiment of the disclosure, a display apparatus including a plurality of pixels is provided. Each of the pixels includes a first pixel driver circuit, a second pixel driver circuit, a first driver pad, a second driver pad, a first LED element, a first connection line, a second connection line, a first repair pad, and a second repair pad. The first driver pad and the second driver pad are electrically connected to the first pixel driver circuit and the second pixel driver circuit, respectively. A first electrode of the first LED element is electrically connected to the first driver pad. The first connection line and the second connection line are electrically connected to the first pixel driver circuit and the second pixel driver circuit, respectively. The first repair pad and the second repair pad are electrically connected to the first connection line and the second connection line, respectively, and the first repair pad, the second repair pad, the first driver pad, and the second driver pad are structurally separated. A first pixel of the pixels further includes a second LED element that overlaps the first repair pad and the second repair pad of the first pixel, and a first electrode of the second LED element is electrically connected to the second repair pad.

In an embodiment of the disclosure, an area of one of the first repair pad and the second repair pad of the first pixel is smaller than an area of one of the first driver pad and the second driver pad of the first pixel.

In an embodiment of the disclosure, each of the pixels further includes a common pad, wherein a second electrode of the first LED element and a second electrode of the second LED element are electrically connected to the common pad, and the first repair pad and the second repair pad are disposed on one side of the common pad.

In an embodiment of the disclosure, the second LED element is electrically connected to the first repair pad and the second repair pad of the first pixel, and the first connection line has a disconnection point.

In an embodiment of the disclosure, each of the pixels further includes an auxiliary pad, wherein the auxiliary pad is disposed above the first repair pad and the second repair pad and overlaps the first repair pad and the second repair pad.

In an embodiment of the disclosure, the second LED element is disposed on the auxiliary pad and electrically connected to the auxiliary pad, and the auxiliary pad and the second repair pad have a welding point.

According to an embodiment of the disclosure, a display apparatus including a plurality of pixels is provided. Each of the pixels includes a first pixel driver circuit, a second pixel driver circuit, a third pixel driver circuit, a first driver pad, a second driver pad, a third driver pad, a common pad, a plurality of first LED elements, a first connection line, a second connection line, a third connection line, a first repair pad, a second repair pad, and a third repair pad. The first driver pad, the second driver pad, and the third driver pad are electrically connected to the first pixel driver circuit, the second pixel driver circuit, and the third pixel driver circuit, respectively. A plurality of first electrodes of the first LED elements are electrically connected to the first driver pad, the second driver pad, and the third driver pad, respectively, and a plurality of second electrodes of the first LED elements are electrically connected to the common pad. The first connection line, the second connection line, and the third connection line are electrically connected to the first pixel driver circuit, the second pixel driver circuit, and the third pixel driver circuit, respectively. The first repair pad, the second repair pad, and the third repair pad are electrically connected to the first connection line, the second connection line, and the third connection line, respectively, and are structurally separated from the first driver pad, the second driver pad, and the third driver pad, wherein the first repair pad, the second repair pad, and the third repair pad are arranged along an edge of common pad.

In an embodiment of the disclosure, an area of one of the first repair pad, the second repair pad, and the third repair pad is smaller than an area of one of the first driver pad, the second driver pad, and the third driver pad.

In an embodiment of the disclosure, the first driver pad, the second driver pad, and the third driver pad are disposed on opposite sides of the common pad, and the first repair pad, the second repair pad, and the third repair pad are disposed on one side of the common pad.

In an embodiment of the disclosure, each of the pixels further includes an auxiliary pad that is disposed above and overlaps the first repair pad, the second repair pad, and the third repair pad.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
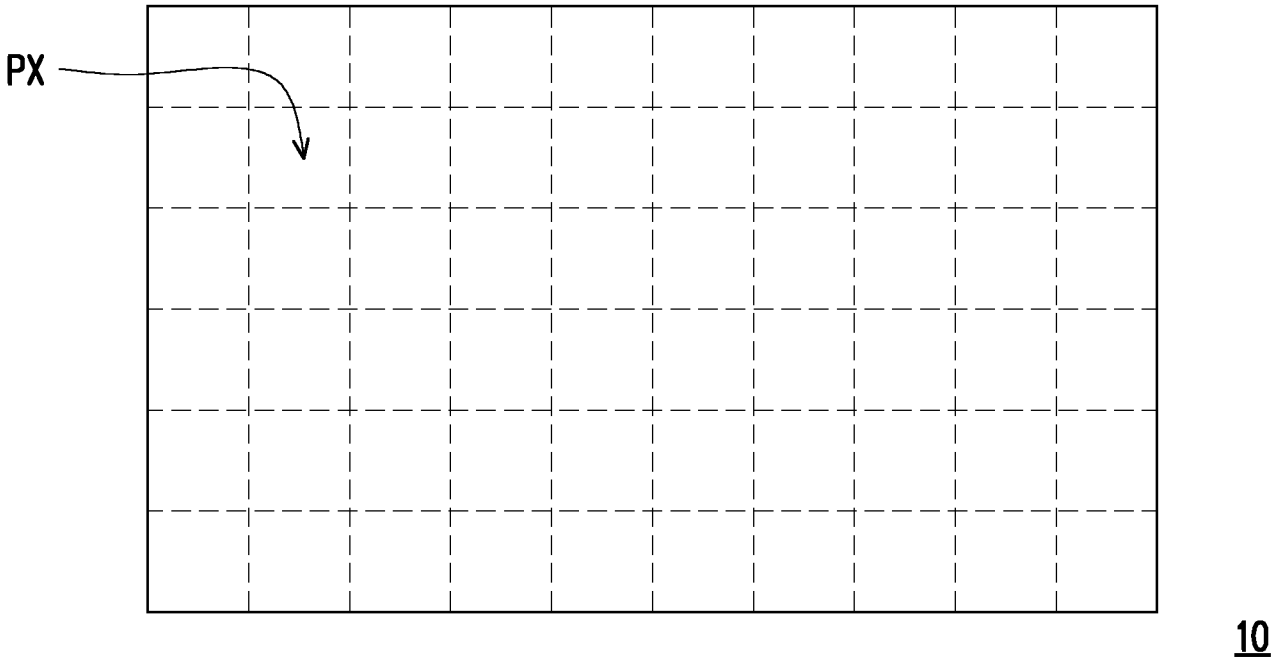
FIG. 1 is a schematic top view of a display apparatus 10 according to an embodiment of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

Directional terminology used in the embodiments, such as "top", "bottom", "front", "back", "left", "right", etc., is used with reference to the orientation of the figure(s) being described and are not intended to be limiting of the disclosure. In the drawings, general characteristics of methods, structures, and/or materials used in specific embodiments are illustrated. However, these drawings should not be construed to define or limit a scope or nature covered by these embodiments. For instance, for simplicity's sake, a relative size, thickness, and location of each film layer, region, and/or structure may be reduced or enlarged. It will be understood that when an element such as a layer, a film, a region, or a substrate is referred to be "on" or "connected to" another element, it may be directly on or connected to the other another element, or intermediate elements may also exist there between. Comparatively, when an element is referred to be "directly on" or "directly connected" to another, none other intermediate element exits there between. As used herein, the "connection" may refer to physical and/or electrical connection. Furthermore, "electrical connection" or "coupling" of two elements may refer to that other elements may exist between the two elements.

In the embodiments listed in the disclosure, the same or similar elements be denoted by the same or similar reference numerals, and descriptions thereof will be omitted. In addition, the features in different embodiments may be combined with each other in case of no confliction, and simple equivalent changes and modifications made according to the specification or a scope of the patent application are still within a protection scope of the patent. Moreover, the terms "first" and "second" mentioned in the specification or the scope of the patent application are only used to name discrete elements or to distinguish different embodiments or ranges, but are not used to limit an upper limit or a lower limit of an amount of the elements, and are also not used to limit a manufacturing sequence or a setting sequence of the elements.

"About", "approximate", or "substantial" used in the specification includes a stated value and an average value within an acceptable deviation range from a specific value determined by those with ordinary skills in the art while considering the discussed measurement and a specific number of errors associated with the measurement (i.e. limits of a measurement system). For instance, "about" may represent to be within one or more standard deviations of the stated value, or within ±30%, ±20%, ±10%, and ±5%. Moreover, an acceptable deviation range or standard deviation may be selected for the "about", "approximate" or "substantial" used in the specification based on optical properties, etching properties, or other properties without using one standard deviation for all properties.

FIG. 1 is a schematic top view of a display apparatus 10 according to an embodiment of the disclosure.

Figure 2:
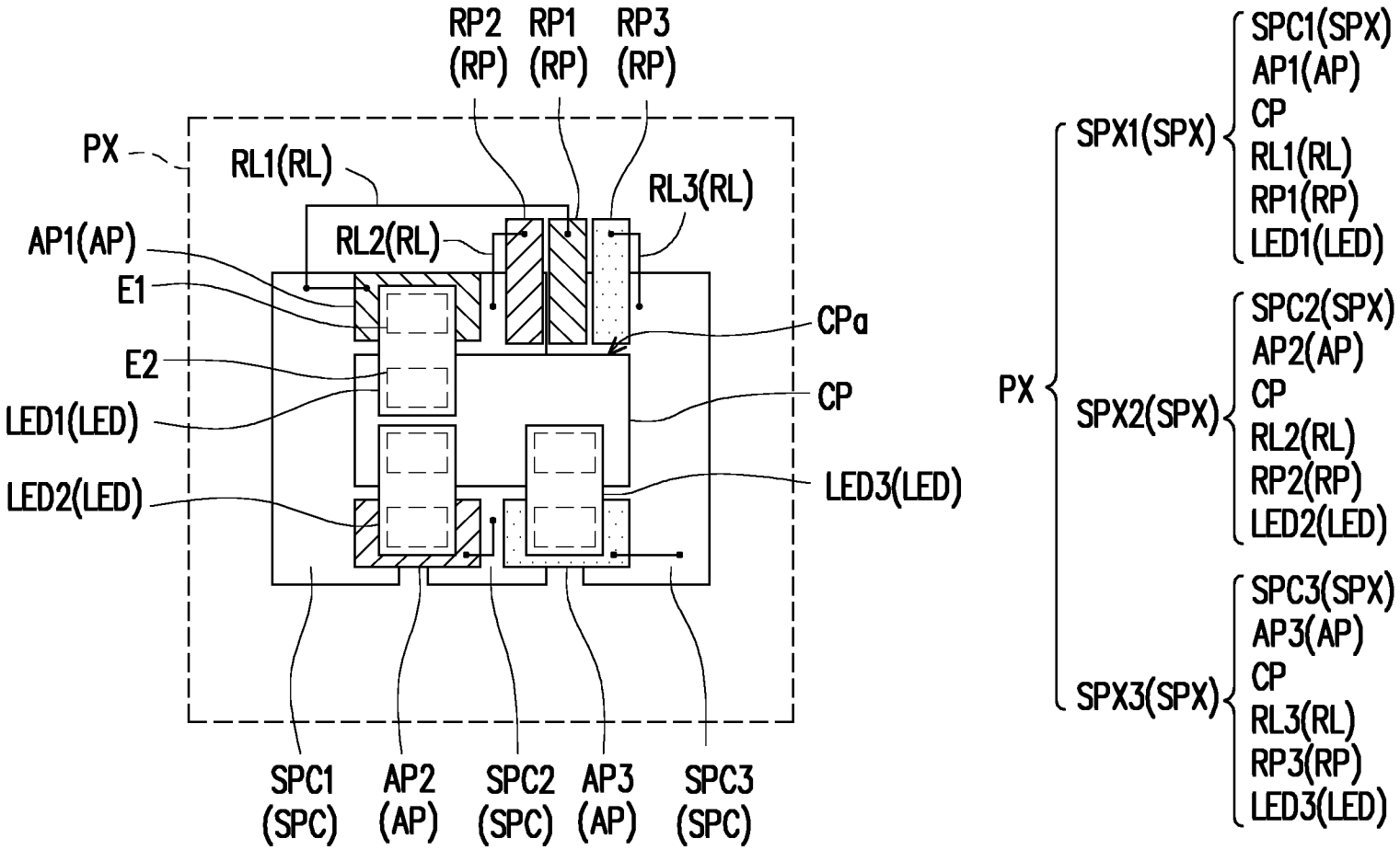
FIG. 2 is a schematic top view of a pixel PX of the display apparatus 10 in FIG. 1.

FIG. 2 is a schematic top view of a pixel PX of the display apparatus 10 in FIG. 1.

Figure 3:
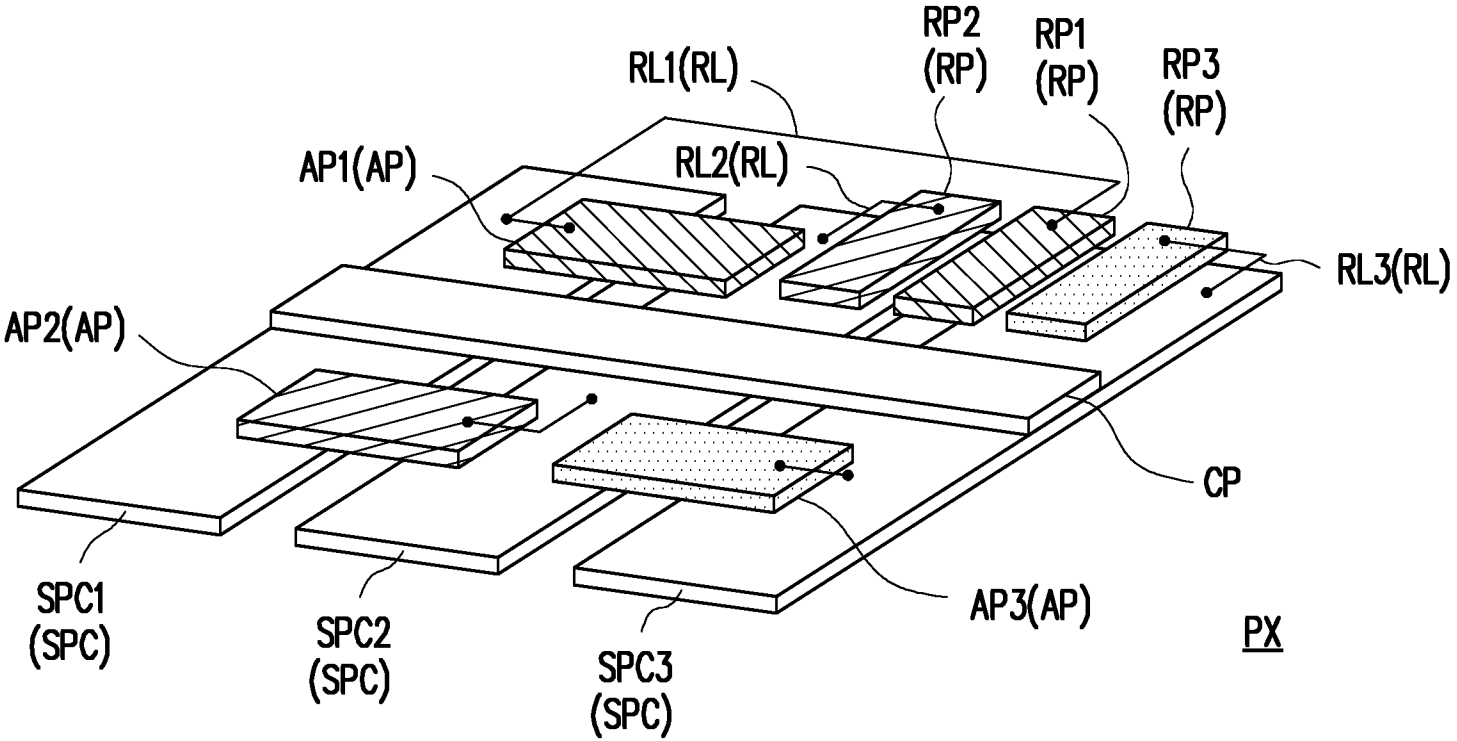
FIG. 3 is a stereo three-dimensional view of a pixel PX in FIG. 2.

FIG. 3 is a stereo three-dimensional view of a pixel PX in FIG. 2.

Figure 4:
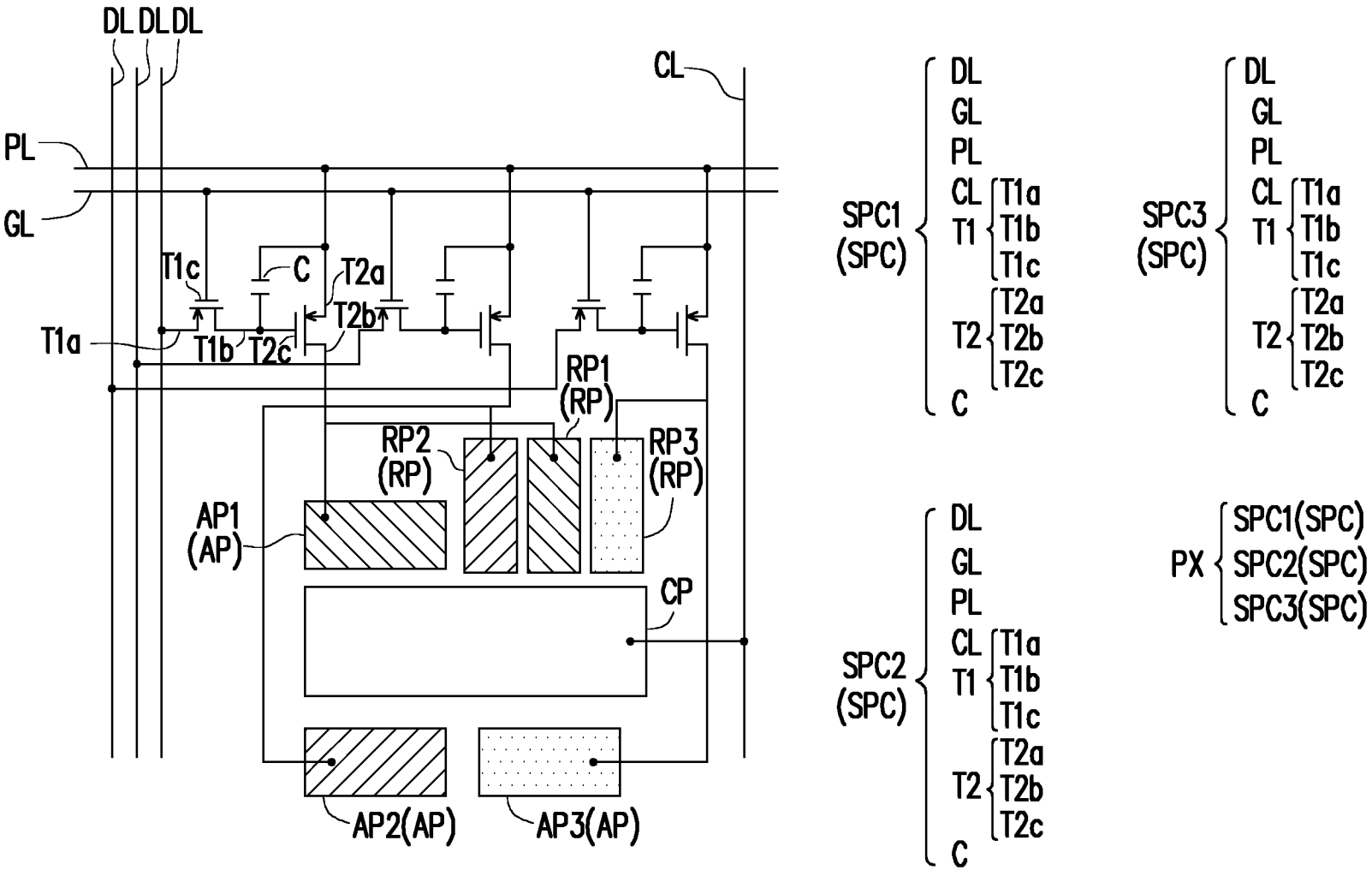
FIG. 4 is a schematic view of an equivalent circuit of the pixel PX in FIG. 2.

FIG. 4 is a schematic view of an equivalent circuit of the pixel PX in FIG. 2. The LED elements in FIG. 2 are omitted in FIG. 4.

In particular, FIG. 2, FIG. 3, and FIG. 4 illustrate the pixel PX that is not repaired.

With reference to FIG. 1 and FIG. 2, the display apparatus 10 includes a plurality of pixel PXs arranged in an array. With reference to FIG. 2, FIG. 3 and FIG. 4, each of the pixels PX includes a plurality of sub-pixels SPX. Each of the sub-pixels SPX has a pixel driver circuit SPC, a driver pad AP, a common pad CP, a connection line RL, a repair pad RP, and an LED element LED, wherein the driver pad AP is electrically connected to the pixel driver circuit SPC, the common pad CP is electrically connected to the pixel driver circuit SPC and is structurally separated from the driver pad AP, the connection line RL is electrically connected to the pixel driver circuit SPC, the repair pad RP is electrically connected to the connection line RL and structurally separated from the driver pad AP and the common pad CP, a first electrode E1 of the LED element LED is electrically connected to the driver pad AP or the repair pad RP, and a second electrode E2 of the LED element LED is electrically connected to the common pad CP.

In the embodiment, the LED element LED of each of the sub-pixels SPX is transferred from a growth substrate (not shown) to a back plate having a plurality of pixel driver circuit SPCs, a plurality of driver pads APs, a plurality of common pads CP, a plurality of connection lines RL, and a plurality of repair pads RP, and the display apparatus 10 is further formed. For instance, in the embodiment, the LED element LED may be formed on a sapphire substrate and then transferred to the back plate, and the LED element LED may be an inorganic LED element that includes but is not limited to a micro LED, a mini LED, or any other inorganic LED of another size.

With reference to FIG. 2 and FIG. 4, in the embodiment, the pixel driver circuit SPC of each of the sub-pixels SPX includes a data line DL, a scan line GL, a power line PL, a common line CL, a first transistor T1, a second transistor T2, and a capacitor C, wherein a first terminal T1*a* of the first transistor T1 is electrically connected to the data line DL, a control terminal T1*c* of the first transistor T1 is electrically connected to the scan line GL, a second terminal T1*b* of the first transistor T1 is electrically connected to a control terminal T2*c* of the second transistor T2, a first terminal T2*a* of the second transistor T2 is electrically connected to the power line PL, the capacitor C is electrically connected to the second terminal T1*b* of the first transistor T1 and the first terminal T2*a* of the second transistor T2, the driver pad AP is electrically connected to a second terminal T2*b* of the second transistor T2, the repair pad RP is electrically connected to the second terminal T2*b* of the second transistor T2 through the connection line RL, and the common pad CP is electrically connected to the common line CL.

For instance, in the embodiment, each of the pixels PX may include a plurality of sub-pixels SPX1, SPX2, and SPX3 for displaying different colors, wherein a plurality of LED elements LED1, LED2, and LED3 of the sub-pixels SPX1, SPX2, and SPX3 serve to emit a first color beam, a second color beam, and a third color beam, respectively, so that the sub-pixels SPX1, SPX2, and SPX3 can display a first color, a second color, and a third color, respectively. In the embodiment, the first color, the second color, and the third color are red, green, and blue, respectively, but the disclosure is not limited thereto.

In the embodiment, the sub-pixel SPX1 for displaying the first color includes a pixel driver circuit SPC1, a driver pad AP1, a repair pad RP1, a connection line RL1, and the LED element LED1, wherein the driver pad AP1 is electrically connected to the second terminal T2*b* of the second transistor T2 of the pixel driver circuit SPC1, the repair pad RP1 is electrically connected to the second terminal T2*b* of the second transistor T2 of the pixel driver circuit SPC1 through the connection line RL1, and the first electrode E1 of the LED element LED1 is electrically connected to the driver pad AP1 or the repair pad RP1; the sub-pixel SPX2 for displaying the second color includes a pixel driver circuit SPC2, a driver pad AP2, a repair pad RP2, a connection line RL2, and the LED element LED2, wherein the driver pad AP2 is electrically connected to the second terminal T2*b* of the second transistor T2 of the pixel driver circuit SPC2, the repair pad RP2 is electrically connected to the second terminal T2*b* of the second transistor T2 of the pixel driver circuit SPC2 through the connection line RL2, and the first electrode E1 of the LED element LED2 is electrically connected to the driver pad AP2 or the repair pad RP2; the sub-pixel SPX3 for displaying the third color includes a pixel driver circuit SPC3, a driver pad AP3, a repair pad RP3, a connection line RL3, and the LED element LED3, wherein the driver pad AP3 is electrically connected to the second terminal T2*b* of the second transistor T2 of the pixel driver circuit SPC3, the repair pad RP3 is electrically connected to the second terminal T2*b* of the second transistor T2 of the pixel driver circuit SPC3 through the connection line RL3, and the first electrode E1 of the LED element LED3 is electrically connected to the driver pad AP3 or the repair pad RP3.

With reference to FIG. 2, in the embodiment, in order to reduce a layout area of the pixel PX to achieve high resolution of the display apparatus 10, the second electrodes E2 of the LED elements LED1, LED2, and LED3 of the same pixel PX are electrically connected to the same common pad CP; in other words, the sub-pixels SPX1, SPX2, and SPX3 of the same pixel PX share the same common pad CP.

In order to take the reduction of the layout area of the pixel PX and the repairability of each sub-pixel SPX of the pixel PX into consideration, in the same pixel PX, the repair pads RP1, RP2, and RP3 are arranged along an edge CPa of the common pad CP. Specifically, in the embodiment, the driver pad AP1, the driver pad AP2, and the driver pad AP3 are disposed on two opposite sides of the common pad CP, and the repair pad RP1, the repair pad RP2, and the repair pad RP3 are disposed on the same side of the common pad CP.

For instance, in the embodiment, the driver pad AP1 of the sub-pixel SPX1 for displaying the first color and the repair pads RP1, RP2, and RP3 of all sub-pixels SPX are disposed on a first side (e.g., an upper side) of the common pad CP, and the driver pads AP2 and AP3 of the sub-pixels SPX2 and SPX3 for displaying the second color and the third color are disposed on a second side (e.g., a lower side) of the common pad CP.

FIG. 2 and FIG. 3 illustrate one pixel PX of the display apparatus 10, and the pixel PX is not repaired.

Figure 5:
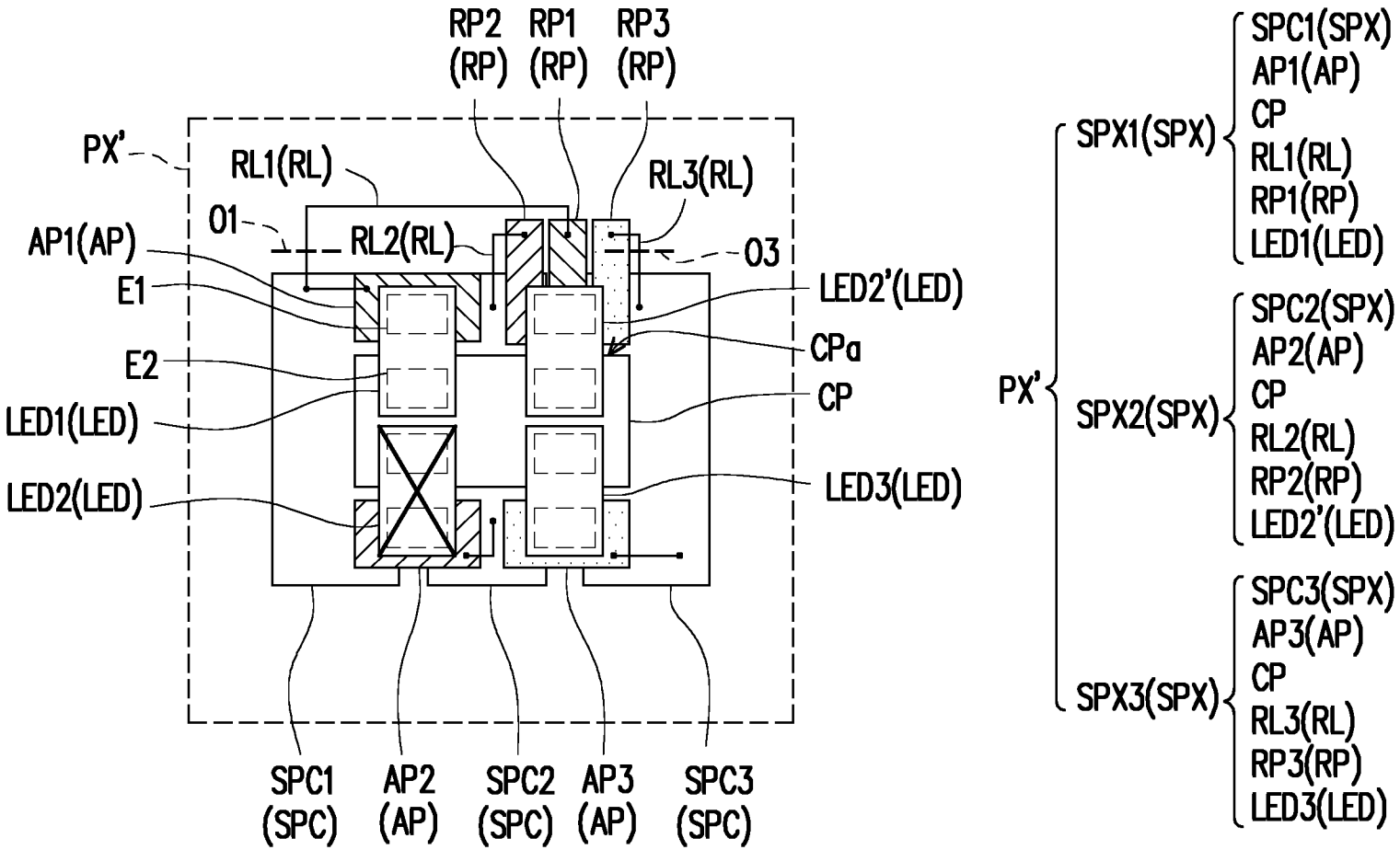
FIG. 5 is a schematic top view of the pixel PX in FIG. 2 after repair.

FIG. 5 is a schematic top view of the pixel PX in FIG. 2 after repair. That is, FIG. 5 shows the repaired pixel PX'.

Figure 6:
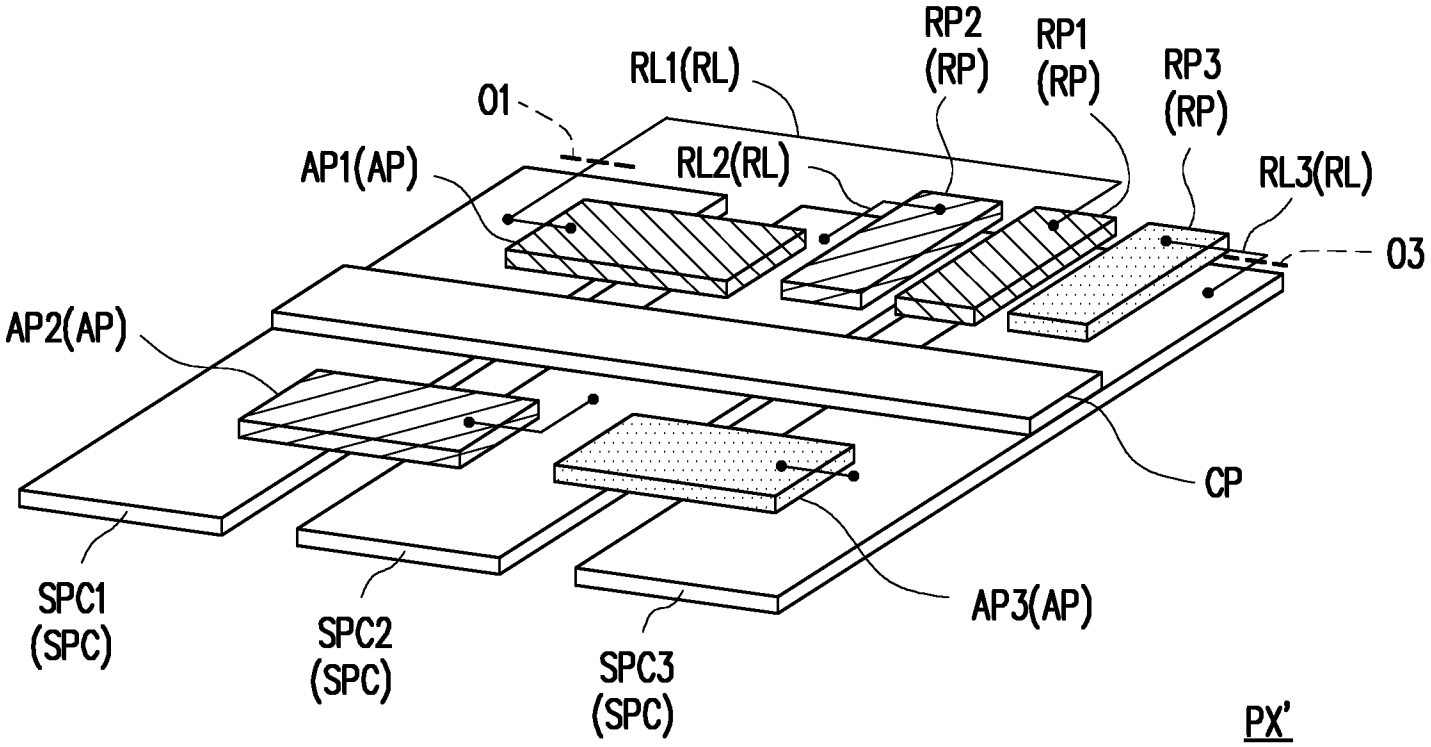
FIG. 6 is a schematic top view of a pixel PX in FIG. 3 after repair.

FIG. 6 is a schematic top view of a pixel PX in FIG. 3 after repair. That is, FIG. 6 shows the repaired pixel PX'. The LED elements in FIG. 5 are omitted in FIG. 6.

With reference to FIG. 2 and FIG. 3, in the embodiment, before the pixel PX is repaired or if the pixel PX does not need to be repaired, the first electrode E1 of the LED element LED1, the first electrode E1 of the LED element LED2, and the first electrode E1 of the LED element LED3 are respectively disposed on and electrically connected to the driver pad AP1, the driver pad AP2, and the driver pad AP3, respectively, the second electrode E2 of the LED element LED1, the second electrode E2 of the LED element LED2, and the second electrode E2 of the LED element LED3 are disposed on and electrically connected to the common pad CP, the connection lines RL1, RL2, and RL3 are not disconnected, the repair pad RP1 is electrically connected to the pixel driver circuit SPC1 through the connection line RL1, the repair pad RP2 is electrically connected to the pixel driver circuit SPC2 through the connection line RL2, and the repair pad RP3 is electrically connected to the pixel driver circuit SPC3 through the connection line RL3.

With reference to FIG. 5 and FIG. 6, in the embodiment, if the sub-pixel SPX2 for displaying one of the colors is abnormal (e.g., the LED element LED2 is damaged or is not properly electrically connected to the pixel driver circuit SPC2), another transfer process may be performed to place a normal LED element LED2' on the repair pads RP1, RP2, and RP3 of the sub-pixels SPX1, SPX2, and SPX3, so that the LED element LED2' overlaps the repair pads RP1, RP2, and RP3, and that the first electrode E1 of the LED element LED2' is electrically connected to the repair pads RP1, RP2, and RP3 of the sub-pixels SPX1, SPX2, and SPX3; besides, the second electrode E2 of the LED element LED2' is electrically connected to the common pad CP.

In addition, the repair lines RL1 and RL3 of the sub-pixels SPX1 and SPX3 that do not need to be repaired are disconnected, so that the repair lines RL1 and RL3 have disconnection points O1 and O3. For instance, in the embodiment, the repair lines RL1 and RL3 of the sub-pixels SPX1 and SPX3 that do not need to be repaired may be disconnected by laser. As such, although the first electrode E1 configured to repair the LED element LED2' of the sub-pixel SPX2 is electrically connected to the repair pads RP1, RP2, and RP3 of the sub-pixels SPX1, SPX2, and SPX3 at the same time, the first electrode E1 of the LED element LED2' is electrically connected to the pixel driver circuit SPC2 of the sub-pixel SPX2 that is required to be repaired through the repair pad RP2 and the connection line RL2, while the first electrode E1 of the LED element LED2' is not electrically connected to the pixel driver circuits SPC1 and SPC3 of the sub-pixels SPX1 and SPX3 that do not need to be repaired through the repair pad RP1, the connection line RL1, the repair pad RP3, and the connection line RL3. Thereby, the original abnormal sub-pixel SPX2 may be repaired, and the pixel PX' may perform the normal display function.

It should be mentioned that repairing the sub-pixel SPX2 configured to display the second color is taken as an example, but the disclosure is not limited thereto; if the sub-pixel SPX configured to display another color is abnormal, the sub-pixel SPX may also be repaired in a similar manner. For instance, in an embodiment that is not shown, if the sub-pixel SPX1 for displaying the first color is found abnormal (e.g., the LED element LED1 is damaged or is not properly electrically connected to the pixel driver circuit SPC1), another transfer process may be performed to place a normal LED element emitting substantially the same color light as the color light emitted by the LED element LED1 on the repair pads RP1, RP2, and RP3 of the sub-pixels SPX1, SPX2, and SPX3, and the first electrode E1 of the normal LED element (not shown) is electrically connected to the repair pads RP1, RP2, and RP3 of the sub-pixels SPX1, SPX2, and SPX3; besides, the second electrode E2 of the normal LED element (not shown) is electrically connected to the common pad CP; in addition, the repair lines RL2 and RL3 of the sub-pixel SPX2 and SPX3 that do not need to be repaired are also disconnected. As such, although the first electrode E1 of the normal LED element (not shown) of the sub-pixel SPX1 configured to repair the sub-pixel SPX1 is electrically connected to the repair pads RP1, RP2, and RP3 of the sub-pixels SPX1, SPX2, and SPX3 at the same time, the first electrode E1 of the normal LED element is electrically connected to the pixel driver circuit SPC1 of the sub-pixel SPX1 that is required to be repaired through the repair pad RP1 and the connection line RL1, while the first electrode E1 of the normal LED element is not electrically connected to the pixel driver circuits SPC2 and SPC3 of the sub-pixels SPX2 and SPX3 that do not need to be repaired through the repair pad RP2, the connection line RL2, the repair pad RP3, and the connection line RL3. Thereby, the original abnormal sub-pixel SPX1 may be repaired, and the pixel PX' may perform the normal display function.

To sum up, in the embodiment, the layout area of the pixel PX is reduced, the resolution of the display apparatus 10 is improved, and a new LED element LED may be transferred for repair according to the color to be displayed by the abnormal sub-pixel SPX of each pixel PX. In the embodiment, it is not limited that only the sub-pixel SPX for displaying a certain color in one pixel PX can be repaired. The display apparatus 10 provided in the embodiment may achieve high resolution, and the repairability of the sub-pixels SPX for displaying various colors is taken into consideration.

It should be mentioned that the reference numbers and some descriptions provided in the previous embodiment are also applicable in the following embodiments, the same reference numbers serve to indicate the same or similar elements, and the description of the same technical content is omitted hereinafter. The description of the omitted parts may be referred to as the descriptions provided in the previous embodiments and will not be repeated in the following embodiments.

Figure 7:
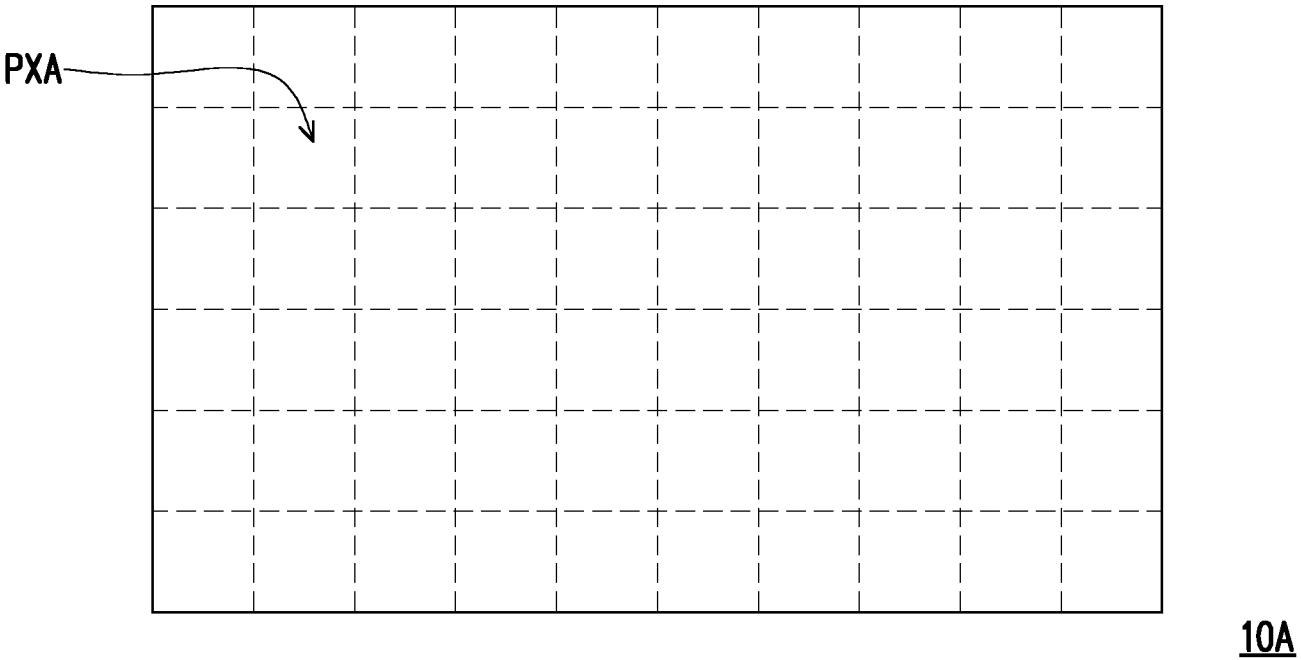
FIG. 7 is a schematic top view of a display apparatus 10A according to another embodiment of the disclosure.

FIG. 7 is a schematic top view of a display apparatus 10A according to another embodiment of the disclosure.

Figure 8:
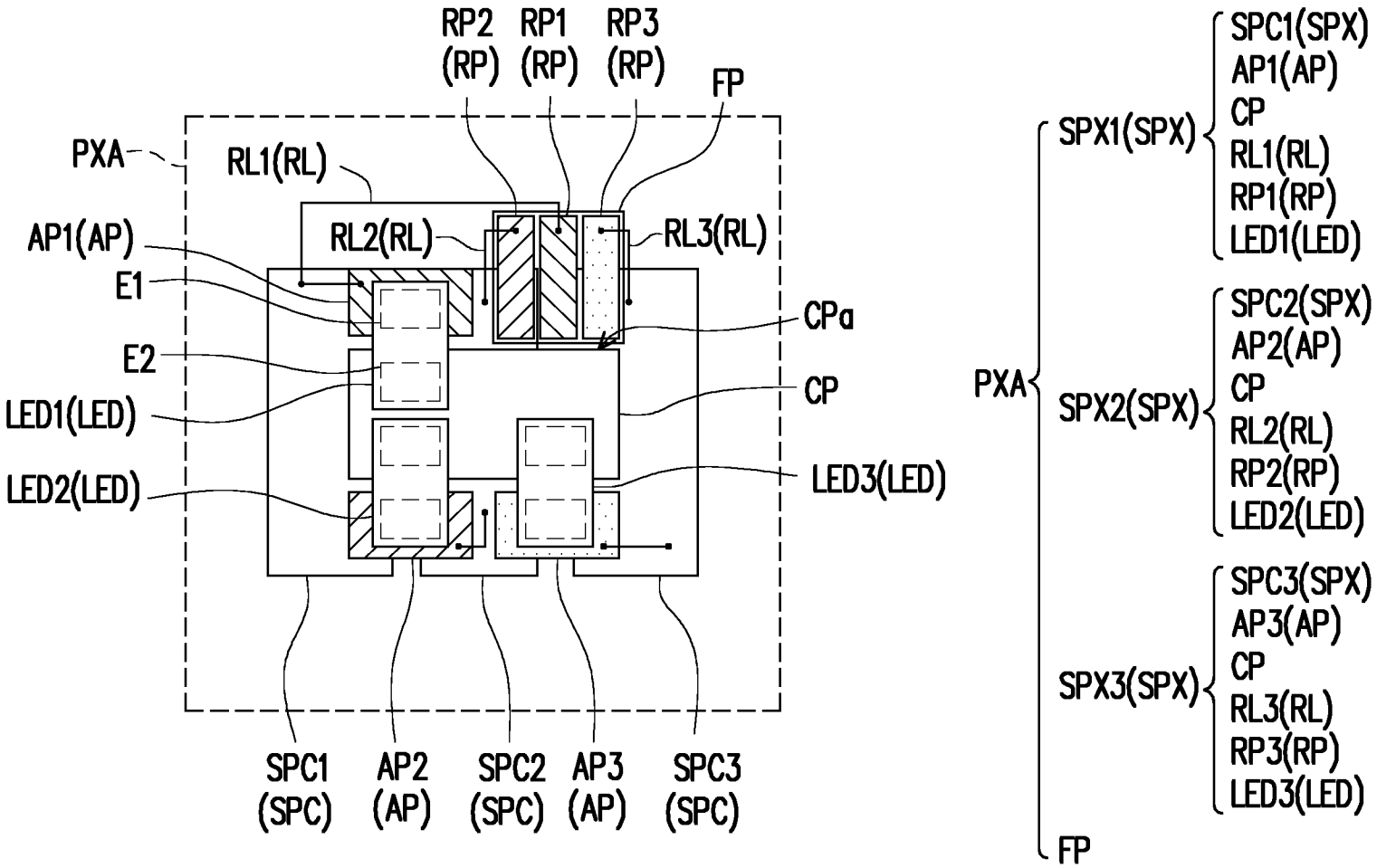
FIG. 8 is a schematic top view of a pixel PXA of the display apparatus 10A in FIG. 7.

FIG. 8 is a schematic top view of a pixel PXA of the display apparatus 10A in FIG. 7.

Figure 9:
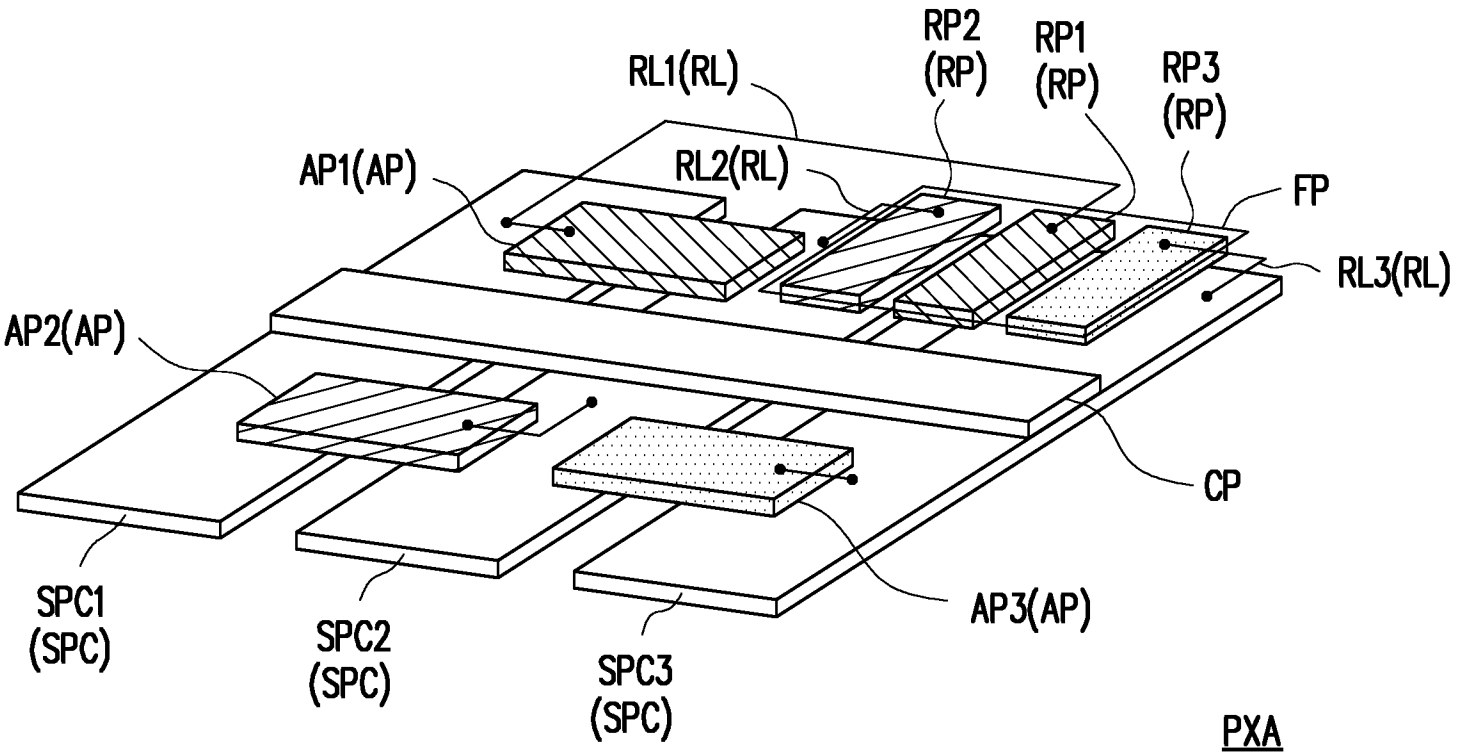
FIG. 9 is a schematic three-dimensional view of a pixel PXA in FIG. 8.

FIG. 9 is a schematic three-dimensional view of a pixel PXA in FIG. 8. The LED elements LED in FIG. 8 are omitted in FIG. 9.

Figure 10:
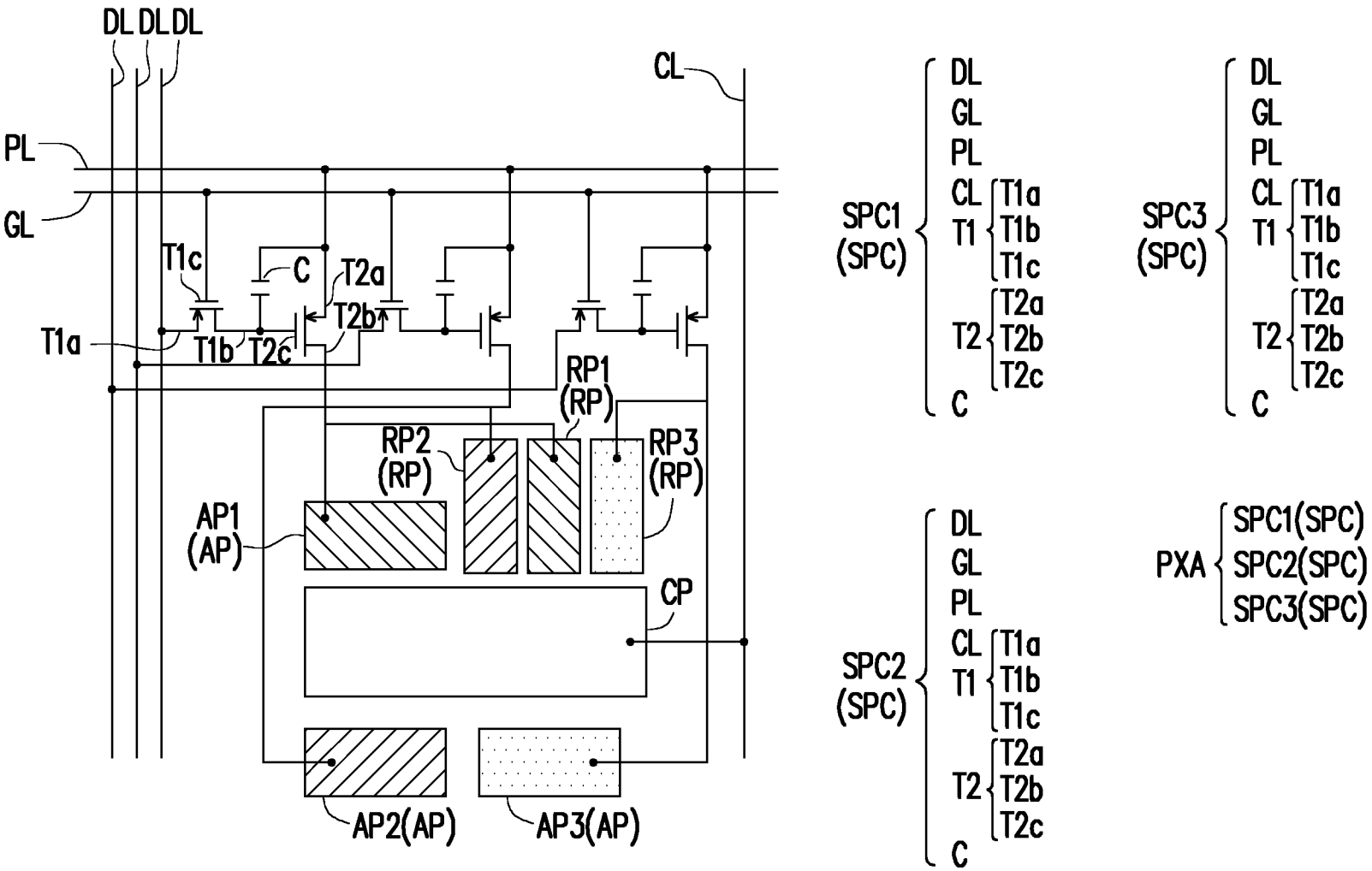
FIG. 10 is a schematic view of an equivalent circuit of the pixel PXA in FIG. 8.

FIG. 10 is a schematic view of an equivalent circuit of the pixel PXA in FIG. 8. The LED elements LED and an auxiliary pad FP in FIG. 2 are omitted in FIG. 8.

Specifically, FIG. 8, FIG. 9, and FIG. 10 illustrate the pixel PX that is not repaired.

With reference to FIG. 7 to FIG. 10, a display apparatus 10A and pixels PXA thereof provided in the embodiment are similar to the display apparatus 10 and the pixels PX provided above, and the difference therebetween lies in that each pixel PXA provided in the embodiment further includes an auxiliary pad FP. With reference to FIG. 8 and FIG. 9, the auxiliary pad FP is disposed above the repair pads RP1, RP2, and RP. Specifically, an insulation layer (not shown) is disposed on the repair pads RP1, RP2, and RP3, and the auxiliary pad FP is disposed on the insulation layer and overlaps the repair pads RP1, RP2, and RP3.

Figure 11:
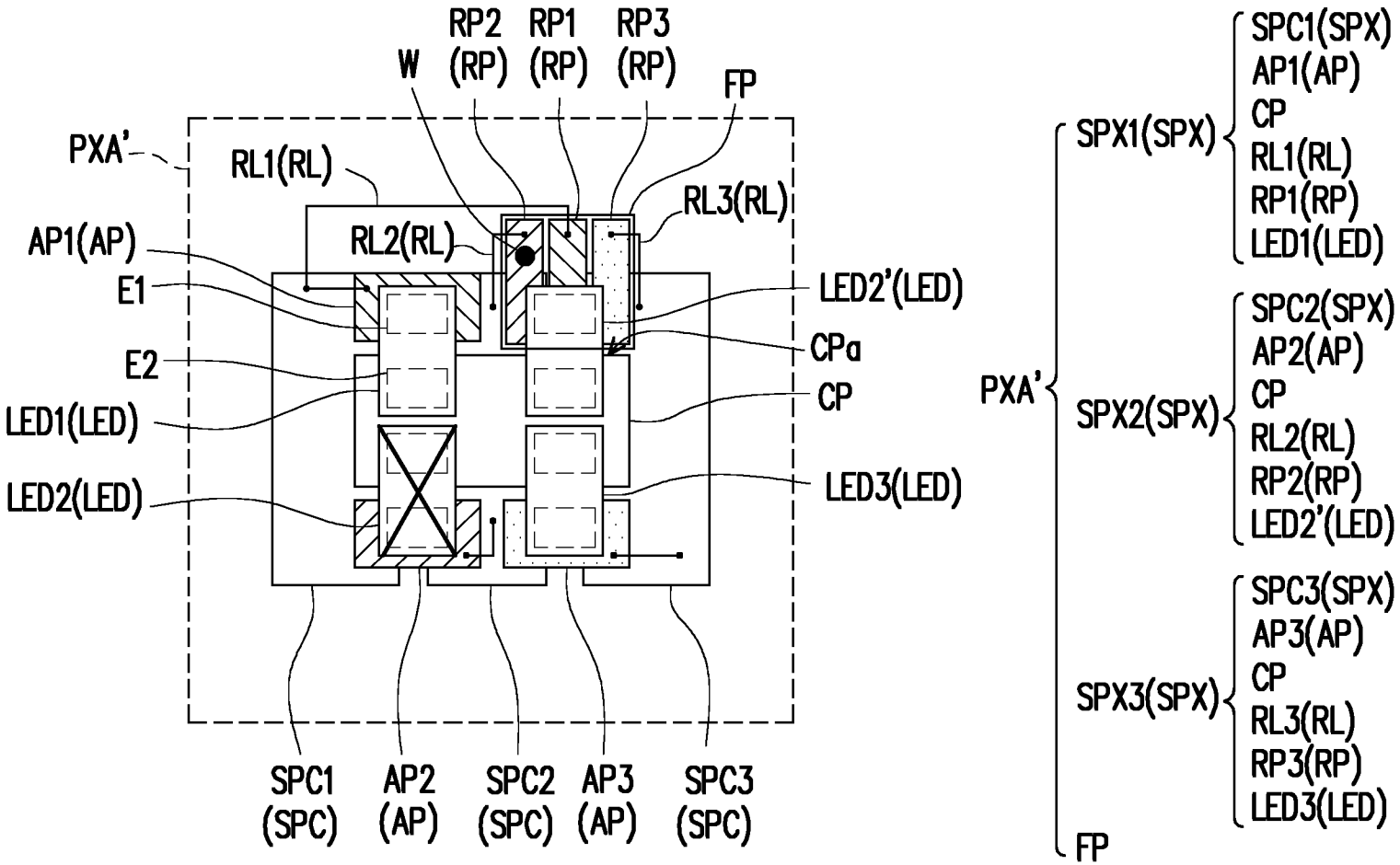
FIG. 11 is a schematic top view of the pixel PXA in FIG. 8 after repair.

FIG. 11 is a schematic top view of the pixel PXA in FIG. 8 after repair. That is, FIG. 11 illustrates the repaired pixel PXA'.

Figure 12:
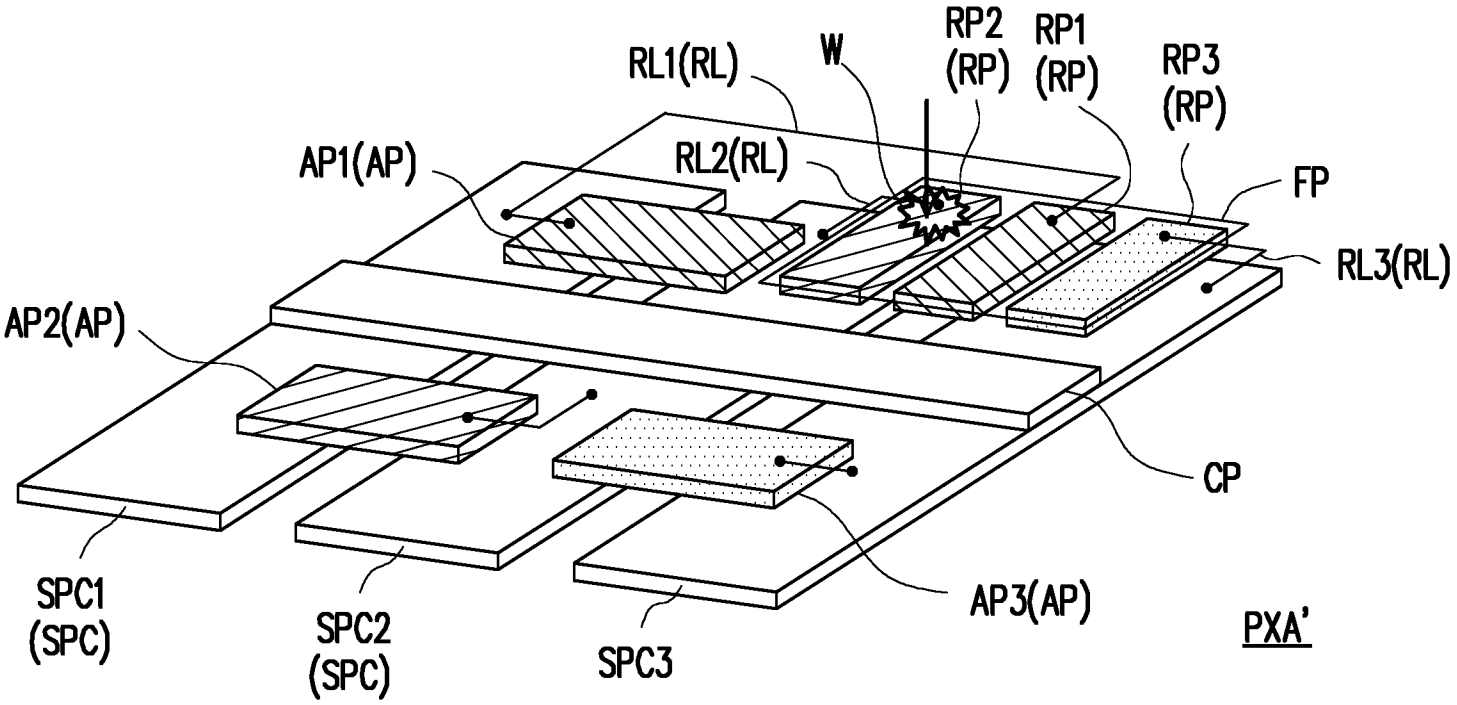
FIG. 12 is a schematic top view of the pixel PXA in FIG. 9 after repair.

FIG. 12 is a schematic top view of the pixel PXA in FIG. 9 after repair. That is, FIG. 12 illustrates the repaired pixel PXA'. The LED elements LED in FIG. 11 are omitted in FIG. 12.

With reference to FIG. 8 and FIG. 9, in the embodiment, before the pixel PXA is repaired, the first electrode E1 of the LED element LED1, the first electrode E1 of the LED element LED2, and the first electrode E1 of the LED element LED3 are disposed on and electrically connected to the driver pad AP1, the driver pad AP2, and the driver pad AP3, respectively, the second electrode E2 of the LED element LED1, the second electrode E2 of the LED element LED2, and the second electrode E2 of the LED element LED3 are disposed on and electrically connected to the common pad CP, the connection lines RL1, RL2, and RL3 are not disconnected, the repair pad RP1 is electrically connected to the pixel driver circuit SPC1 through the connection line RL1, the repair pad RP2 is electrically connected to the pixel driver circuit SPC2 through the connection line RL2, the repair pad RP3 is electrically connected to the pixel driver circuit SPC3 through the connection line RL3, and the auxiliary pad FP is floating and electrically isolated from the repair pads RP1, RP2, and RP3 of the sub-pixels SPX1, SPX2, and SPX3.

With reference to FIG. 11 and FIG. 12, in the embodiment, if the sub-pixel SPX2 for displaying one of the colors is abnormal (e.g., the LED element LED2 is damaged or is not properly electrically connected to the pixel driver circuit SPC2), another transfer process may be performed to place the normal LED element LED2' on the, and the first electrode E1 and the second electrode E2 of the LED element LED2' are electrically connected to the auxiliary pad FP and the common pad CP, respectively. Here, the LED element LED2' overlaps the auxiliary pad FP and the repair pads RP1, RP2, and RP3 below the auxiliary pad FP. In addition, the auxiliary pad FP and the repair pad RP2 of the sub-pixel SPX2 to be repaired are electrically connected. For instance, the auxiliary pad FP and the repair pad RP2 may be laser welded, so that the auxiliary pad FP and the repair pad RP2 have a welding point W and are electrically connected to each other. As such, the first electrode E1 of the LED element LED2' may be electrically connected to the pixel driver circuit SPC2 of the sub-pixel SPX2 that is required to be repaired through the auxiliary pad FP, the welding point W, the repair pad RP2, and the connection line RL2, while the first electrode E1 of the LED element LED2' is not electrically connected to the pixel driver circuits SPC1 and SPC3 of the sub-pixels SPX1 and SPX3 that do not need to be repaired through the auxiliary pixel FP, the repair pad RP1, the connection line RL1, the repair pad RP3, and the connection line RL3. Thereby, the original abnormal sub-pixel SPX2 may be repaired, and the pixel PXA' may perform the normal display function.

It should be mentioned that repairing the sub-pixel SPX2 of the pixel PX configured to display the second color is taken as an example, but the disclosure is not limited thereto; if the sub-pixel SPX of the pixel PX configured to display another color is abnormal, the sub-pixel SPX may also be repaired in a similar manner. For instance, in an embodiment that is not shown, if the sub-pixel SPX1 for displaying the first color is found abnormal (e.g., the LED element LED1 is damaged or is not properly electrically connected to the pixel driver circuit SPC1), another transfer process may be performed to place a normal LED element emitting substantially the same color light as the color light emitted by the LED element LED1 on the auxiliary pad FP, and the first electrode E1 and the second electrode E2 of the normal LED element (not shown) are electrically connected to the auxiliary pad FP and the common pad CP, respectively; besides, the auxiliary pad FP and the repair pad RP2 of the to-be-repaired sub-pixel SPX1 may be laser welded, so that the auxiliary pad FP and the repair pad RP2 have a welding point W (not shown). As such, the normal LED element may be electrically connected to the pixel driver circuit SPC1 of the sub-pixel SPX1 that is required to be repaired through the auxiliary pad FP, the welding point W, the repair pad RP1, and the connection line RL1, while the normal LED element is not electrically connected to the pixel driver circuits SPC2 and SPC3 of the sub-pixels SPX2 and SPX3 that do not need to be repaired through the auxiliary pixel FP, the repair pad RP2, the connection line RL2, the repair pad RP3, and the connection line RL3. Thereby, the original abnormal sub-pixel SPX1 may be repaired, and the pixel PXA' may perform the normal display function.

Similarly, in the embodiment, the layout area of the pixel PXA' is reduced, the resolution of the display apparatus 10A is improved, and a new LED element LED2' may be transferred for repair according to the color to be displayed by the abnormal sub-pixel SPX of each pixel PXA. In the embodiment, it is not limited that only the sub-pixel SPX for displaying a certain color in one pixel PXA can be repaired. The display apparatus 10A provided in the embodiment may achieve high resolution, and the repairability of the sub-pixels SPX for displaying various colors is taken into consideration.

It will be apparent to those skilled in the art that various modifications and variations can be made to the disclosed embodiment without departing from the scope or spirit of the disclosure. In view of the foregoing, it is intended that the disclosure covers modifications and variations provided that they fall within the scope of the following claims and their equivalents.

What is claimed is:

1. A display apparatus, comprising:

a plurality of pixels, each of the pixels comprising:

a first pixel driver circuit and a second pixel driver circuit;

a first driver pad and a second driver pad, electrically connected to the first pixel driver circuit and the second pixel driver circuit, respectively;

a first light-emitting diode element, wherein a first electrode of the first light-emitting diode element is electrically connected to the first driver pad;

a first connection line and a second connection line, electrically connected to the first pixel driver circuit and the second pixel driver circuit, respectively; and a first repair pad and a second repair pad, electrically connected to the first connection line and the second connection line, respectively, and structurally separated from the first driver pad and the second driver pad, wherein a first pixel of the pixels further comprises a second light-emitting diode element, the second light-emitting diode element overlaps the first repair pad and the second repair pad of the first pixel, and a first electrode of the second light-emitting diode element is electrically connected to the second repair pad.

2. The display apparatus according to claim 1, wherein an area of one of the first repair pad and the second repair pad of the first pixel is smaller than an area of one of the first driver pad and the second driver pad of the first pixel.

3. The display apparatus according to claim 1, wherein each of the pixels further comprises:

a common pad, wherein a second electrode of the first light-emitting diode element and a second electrode of the second light-emitting diode element are electrically connected to the common pad, and the first repair pad and the second repair pad are disposed on one side of the common pad.

4. The display apparatus according to claim 1, wherein the second light-emitting diode element is electrically connected to the first repair pad and the second repair pad of the first pixel, and the first connection line has a disconnection point.

5. The display apparatus according to claim 1, wherein each of the pixels further comprises:

an auxiliary pad, disposed above the first repair pad and the second repair pad and overlapping the first repair pad and the second repair pad.

6. The display apparatus according to claim 5, wherein the second light-emitting diode element is disposed on the auxiliary pad and electrically connected to the auxiliary pad, and the auxiliary pad and the second repair pad has a welding point.

7. A display apparatus, comprising:

a plurality of pixels, each of the pixels comprising:

a first pixel driver circuit, a second pixel driver circuit, and a third pixel driver circuit;

a first driver pad, a second driver pad, and a third driver pad, electrically connected to the first pixel driver circuit, the second pixel driver circuit, and the third pixel driver circuit, respectively;

a common pad;

a plurality of first light-emitting diode elements, a plurality of first electrodes of the first light-emitting diode elements being electrically connected to the first driver pad, the second driver pad, and the third driver pad, respectively, a plurality of second electrodes of the first light-emitting diode elements being electrically connected to the common pad;

a first connection line, a second connection line, and a third connection line, electrically connected to the first pixel driver circuit, the second pixel driver circuit, and the third pixel driver circuit, respectively; and a first repair pad, a second repair pad, and a third repair pad, electrically connected to the first connection line, the second connection line, and the third connection line, respectively, and structurally separated from the first driver pad, the second driver pad, and the third driver pad, respectively, wherein the first repair pad, the second repair pad, and the third repair pad are arranged along an edge of the common pad.

8. The display apparatus according to claim 7, wherein an area of one of the first repair pad, the second repair pad, and the third repair pad is smaller than an area of one of the first driver pad, the second driver pad, and the third driver pad.

9. The display apparatus according to claim 7, wherein the first driver pad, the second driver pad, and the third driver pad are disposed on opposite sides of the common pad, and the first repair pad, the second repair pad, and the third repair pad are disposed on one side of the common pad.

10. The display apparatus according to claim 7, wherein each of the pixels further comprises:

an auxiliary pad, disposed above the first repair pad, the second repair pad, and the third repair pad and overlapping the first repair pad, the second repair pad, and the third repair pad.

* * * * *